US009482214B2

(12) United States Patent
Kim

(10) Patent No.: US 9,482,214 B2
(45) Date of Patent: Nov. 1, 2016

(54) HYDRAULIC CIRCUIT FOR CONTROLLING BOOMS OF CONSTRUCTION EQUIPMENT

(75) Inventor: Sung-Gon Kim, Changwon-si (KR)

(73) Assignee: VOLVO CONSTRUCTION EQUIPMENT AB, Eskilstuna (SE)

( * ) Notice: Subject to any disclaimer, the term of this patent is extended or adjusted under 35 U.S.C. 154(b) by 437 days.

(21) Appl. No.: 14/006,116

(22) PCT Filed: Apr. 19, 2011

(86) PCT No.: PCT/KR2011/002777

§ 371 (c)(1),
(2), (4) Date: Sep. 19, 2013

(87) PCT Pub. No.: WO2012/144665

PCT Pub. Date: Oct. 26, 2012

(65) Prior Publication Data

US 2014/0010688 A1 Jan. 9, 2014

(51) Int. Cl.
*F15B 13/16* (2006.01)
*F04B 17/00* (2006.01)
(Continued)

(52) U.S. Cl.
CPC ..... *F04B 17/00* (2013.01); *E02F 9/2203* (2013.01); *E02F 9/226* (2013.01); *E02F 9/2217* (2013.01);
(Continued)

(58) Field of Classification Search
CPC ..... F15B 11/0413; F15B 11/044; F15B 11/0445
See application file for complete search history.

(56) References Cited

U.S. PATENT DOCUMENTS 6,907,815 B2 6/2005 Kim
2004/0237771 A1 12/2004 Kim
(Continued)

FOREIGN PATENT DOCUMENTS

JP 2003-106304 A 4/2003
JP 2011-002092 A 1/2011
(Continued)

OTHER PUBLICATIONS

International Search Report (in Korean and English) and Written Opinion (in Korean) for PCT/KR2011/002777, mailed Jan. 11, 2012; ISA/KR.
(Continued)

*Primary Examiner* — Thomas E. Lazo
*Assistant Examiner* — Daniel Collins
(74) *Attorney, Agent, or Firm* — Harness, Dickey & Pierce, P.L.C.

(57) ABSTRACT

Disclosed is a hydraulic circuit for controlling booms of construction equipment, wherein working oil which is relieved from a large chamber of a boom cylinder passes through an orifice so as to prevent the boom from lowering if an overload is applied when the boom is not being operated. The hydraulic circuit for controlling booms of construction equipment includes: a boom cylinder which is connected to a hydraulic pump via a first path and a second path; a boom control valve which is mounted on the path between the hydraulic pump and the boom cylinder; a holding valve which is mounted between the boom control valve and the first path of the boom cylinder and prevents the natural lowering of a boom when the boom control valve is in a neutral position; a port relief valve which is mounted to the first path at the lower side of a holding poppet and relieves working oil when an overload is generated at the first path; and an orifice valve which is mounted at the lower side of the port relief valve, relieves the working oil which passes through the port relief valve when the boom control valve is neutral so as to relieve the working oil through an orifice, and discharges the working oil which passes through the port relief valve to a hydraulic tank at the time of conversion due to boom-up pilot signal pressure which is applied to the boom control valve.

3 Claims, 1 Drawing Sheet

(51) Int. Cl.

| | |
|---|---|
| ***E02F 9/22*** | (2006.01) |
| ***F15B 11/00*** | (2006.01) |
| *F15B 20/00* | (2006.01) |

(52) U.S. Cl.

CPC ..... *E02F 9/2232* (2013.01); *E02F 9/2271* (2013.01); *E02F 9/2296* (2013.01); *F15B 11/003* (2013.01); *F15B 20/007* (2013.01); *F15B 2211/30515* (2013.01); *F15B 2211/3116* (2013.01); *F15B 2211/355* (2013.01); *F15B 2211/40515* (2013.01); *F15B 2211/41581* (2013.01); *F15B 2211/50536* (2013.01); *F15B 2211/5159* (2013.01); *F15B 2211/7128* (2013.01)

(56) References Cited

U.S. PATENT DOCUMENTS

| | | | |
|---|---|---|---|
| 2006/0283184 | A1 | 12/2006 | Cheong |
| 2010/0313557 | A1 | 12/2010 | Kim |

FOREIGN PATENT DOCUMENTS

| | | | |
|---|---|---|---|
| KR | 10-2004-0102597 | A | 12/2004 |
| KR | 10-0611718 | B1 | 8/2006 |

OTHER PUBLICATIONS

International Preliminary Report on Patentability (Chapter II) (in Korean) for PCT/KR2011/002777, dated Aug. 1, 2013; IPEA/KR.

HYDRAULIC CIRCUIT FOR CONTROLLING BOOMS OF CONSTRUCTION EQUIPMENT

FIELD OF THE INVENTION

The present invention relates to a hydraulic circuit for controlling a boom of a construction machine. More particularly, the present invention relates to a hydraulic circuit for controlling a boom of a construction machine, in which when an overload is applied to the boom cylinder in a state in which the boom is not manipulated, a hydraulic fluid relived from a large chamber of the boom cylinder passes through the orifice so that an operator can mitigate an abrupt descending movement of the boom.

BACKGROUND OF THE INVENTION

A conventional hydraulic circuit for controlling a boom of a construction machine in accordance with the prior art as shown in FIG. 1 includes:

- a hydraulic pump 1 connected to an engine (not shown);
- a boom cylinder 2 connected to the hydraulic pump 1 through a first path (or a large chamber-side flow path of the boom cylinder) 2*a* and a second path (or small chamber-side flow path of the boom cylinder) 2*b;*
- a boom control valve 3 shiftably installed in a flow path provided between the hydraulic pump 1 and the boom cylinder 2 and configured to be shifted to control a start, a stop, and a direction change of the boom cylinder 2;
- a holding valve 6 including a holding poppet 4 installed between the boom control valve 3 and the first flow path 2*a* of the boom cylinder 2 and a drain valve 5 configured to supply or discharge a hydraulic fluid to or from a back pressure chamber 4*a* of the holding poppet 4 so that the natural descending movement of the boom due to fluid leakage, empty weight, and the like is prevented when the boom control valve 3 is in a neutral state; and
- a port relief valve 7 installed in the first path 2*a* at the downstream side of a holding poppet 4 and configured to drain the hydraulic fluid to a hydraulic tank (not shown) when an overload occurs in the first path 2*a*.

In case of such a conventional hydraulic circuit, when an overload is applied to the boom cylinder 2 in a direction in which the boom descends or is lowered in a state in which the boom is not manipulated, an overload exceeding a predetermined pressure of the port relief valve 7 is applied to the port relief valve 7 installed in the first path 2*a*, so that a large chamber-side hydraulic fluid of the boom cylinder 2 is drained to a hydraulic tank (not shown) through the port relief valve 7. Therefore, the conventional hydraulic circuit entails a problem in that there may occur safety accidents due to the abrupt descending movement of the boom.

DETAILED DESCRIPTION OF THE INVENTION

Technical Problems

Accordingly, the present invention has been made to solve the aforementioned problem occurring in the prior art, and it is an object of the present invention to provide a hydraulic circuit for controlling a boom of a construction machine, in which when an overload is applied to the boom cylinder in a state in which the boom is not manipulated, a large chamber-side hydraulic fluid of the boom cylinder passes through the orifice and then is relieved so that an operator can mitigate an abrupt descending movement of the boom.

Technical Solution

To accomplish the above object, in accordance with an embodiment of the present invention, there is provided a hydraulic circuit for controlling a boom of a construction machine, including:

a hydraulic pump connected to an engine;

a boom cylinder connected to the hydraulic pump through a first path and a second path;

a boom control valve shiftably installed in a flow path provided between the hydraulic pump and the boom cylinder and configured to be shifted to control a start, a stop, and a direction change of the boom cylinder;

a holding valve including a holding poppet installed between the boom control valve and the first flow path of the boom cylinder and a drain valve configured to supply or discharge a hydraulic fluid to or from a back pressure chamber of the holding poppet so that the natural descending movement of the boom is prevented when the boom control valve is in a neutral state;

a port relief valve installed in the first path at the downstream side of a holding poppet and configured to relieve the hydraulic fluid when an overload occurs in the first path; and

- an orifice valve installed at the downstream side of the port relief valve and configured such that when the boom control valve is in a neutral state, the hydraulic fluid passing through the port relief valve passes through an orifice 8 to relieve the hydraulic fluid, and when the boom control valve is shifted by a boom-up pilot signal pressure that is applied thereto, the hydraulic fluid passing through the port relief valve 7 is discharged to a hydraulic tank.

According to a more preferable embodiment, the orifice valve is shifted by the boom-up pilot signal pressure that is generated by the lever manipulation of a remote control valve for manipulating a work apparatus.

Advantageous Effect

The hydraulic circuit for controlling a boom of a construction machine in accordance with an embodiment of the present invention as constructed above has the following advantages.

In the case where the arm-out operation of the arm is performed when an overload or a constant load is applied to the boom cylinder in a state in which the boom is not manipulated, a large chamber-side hydraulic fluid of the boom cylinder passes through the orifice and then is relieved so that the descending movement of the boom can be mitigated, and thus an operator can prevent abrupt safety accidents, thereby securing stability and reliability.

BRIEF DESCRIPTION OF THE DRAWINGS

The above objects, other features and advantages of the present invention will become more apparent by describing the preferred embodiments thereof with reference to the accompanying drawings, in which.

EXPLANATION ON REFERENCE NUMERALS OF MAIN ELEMENTS IN THE DRAWINGS

Figure 1:
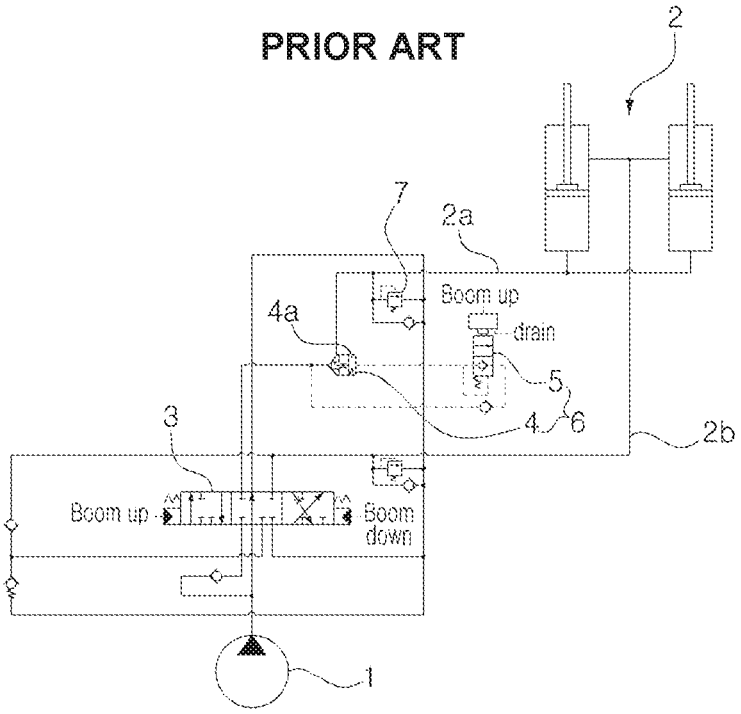
FIG. 1 is a circuit diagram showing a hydraulic circuit for controlling a boom of a construction machine in accordance with the prior art.

1: hydraulic pump
2: boom cylinder
3: boom control valve
4: holding poppet
5: drain valve
6: holding valve
7: port relief valve
8: orifice
9: orifice valve
10: remote control valve (RCV)

PREFERRED EMBODIMENTS OF THE INVENTION

Now, preferred embodiments of the present invention will be described in detail with reference to the accompanying drawings. The matters defined in the description, such as the detailed construction and elements, are nothing but specific details provided to assist those of ordinary skill in the art in a comprehensive understanding of the invention, and the present invention is not limited to the embodiments disclosed hereinafter.

Figure 2:
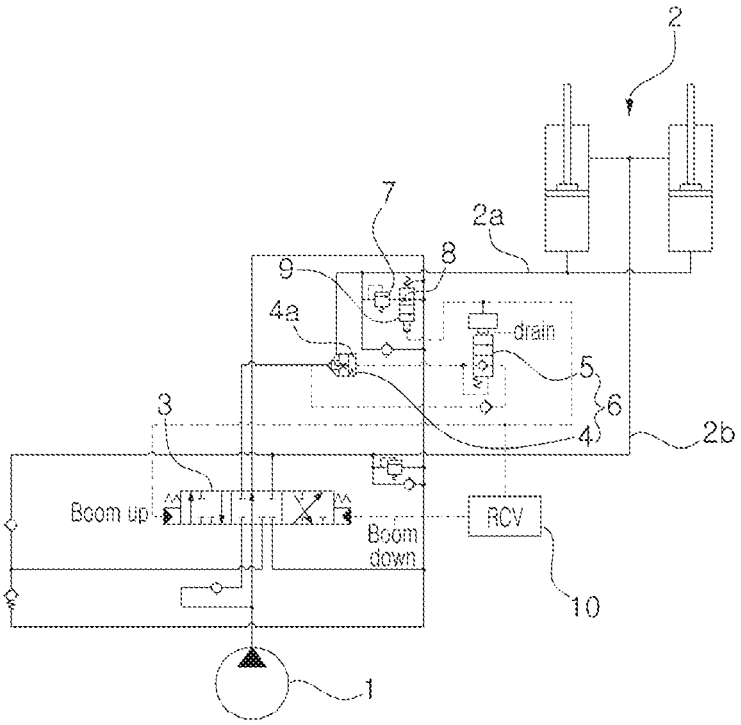
FIG. 2 is a circuit diagram showing a hydraulic circuit for controlling a boom of a construction machine in accordance with an embodiment of the present invention.

A hydraulic circuit for controlling a boom of a construction machine in accordance with an embodiment of the present invention as shown in FIG. 2 includes:

a hydraulic pump 1 connected to an engine (not shown);

a boom cylinder 2 connected to the hydraulic pump 1 through a first path (or a large chamber-side flow path of the boom cylinder) 2*a* and a second path (or small chamber-side flow path of the boom cylinder) 2*b;* a boom control valve 3 shiftably installed in a flow path provided between the hydraulic pump 1 and the boom cylinder 2 and configured to be shifted to control a start, a stop, and a direction change of the boom cylinder 2;

a holding valve 6 including a holding poppet 4 installed between the boom control valve 3 and the first flow path 2*a* of the boom cylinder 2 and a drain valve 5 configured to supply or discharge a hydraulic fluid to or from a back pressure chamber 4*a* of the holding poppet 4 so that the natural descending movement of the boom is prevented when the boom control valve 3 is in a neutral state;

a port relief valve 7 installed in the first path 2*a* at the downstream side of a holding poppet 4 and configured to relieve the hydraulic fluid when an overload occurs in the first path 2*a*; and an orifice valve 9 installed at the downstream side of the port relief valve 7 and configured such that when the boom control valve 3 is in a neutral state, the hydraulic fluid passing through the port relief valve 7 passes through an orifice 8 to relieve the hydraulic fluid, and when the boom control valve 3 is shifted by a boom-up pilot signal pressure that is applied thereto, the hydraulic fluid passing through the port relief valve 7 is discharged to a hydraulic tank (without passing through the orifice 8).

In this case, the orifice valve 9 is shifted by the boom-up pilot signal pressure that is generated by the lever manipulation of a remote control valve (RCV) for manipulating a work apparatus.

Meanwhile, when the boom control valve 3 is in a neutral state, the hydraulic fluid passing through the port relief valve 7 is caused to pass through an orifice 8 to decrease a discharge rate at which the hydraulic fluid is discharged to the hydraulic tank. When the boom control valve 3 is shifted by a boom-up pilot signal pressure that is applied to the boom control valve 3, the hydraulic fluid passing through the port relief valve 7 is directly discharged to a hydraulic tank. Likewise, the configuration in which the orifice 8 is excluded is substantially the same as that of the hydraulic circuit shown in FIG. 1, and thus the detailed description of the configuration and operation thereof will be omitted avoid redundancy. The same elements are denoted by the same reference numerals.

Hereinafter, a use example of the hydraulic circuit for controlling a boom of a construction machine in accordance with an embodiment of the present invention will be described in detail with reference to the accompanying drawings.

As shown in FIG. 2, when an overload is applied to the boom cylinder 2 in a direction in which the boom descends in a state in which the boom is not manipulated, i.e., the boom control valve 3 is in a neural state, a pressure exceeding a predetermined pressure is applied by the port relief valve 3 mounted in the first path 2*a* of the boom cylinder 2, and thus the port relief valve 3 drains the hydraulic fluid to the hydraulic tank.

In this case, the hydraulic fluid relieved after passing through the port relief valve 7 passes through the orifice 8 of the orifice valve 9 installed at the downstream side of the port relief valve 7 and then is discharged to the hydraulic tank (see FIG. 2), so that the discharge rate of the hydraulic fluid feedback to the hydraulic tank can be reduced. For this reason, an operator can mitigate a descending rate at which the boom descends abruptly, thereby securing stability.

On the contrary, a boom-up pilot signal pressure is supplied to the boom control valve 3 through the lever manipulation of the remote control valve (RCV) 10 to manipulate a work apparatus such as the boom so that a spool of the boom control valve 3 is shifted to the right on the drawing sheet. Simultaneously, a part of the boom-up pilot signal pressure is applied to a signal pressure-receiving portion of the orifice valve 9 so that the spool is shifted upwardly on the drawing sheet.

Therefore, the hydraulic fluid discharged from the hydraulic pump 1 is supplied to the boom cylinder 2 through the holding poppet 4 via the first path 2*a*, and thus the boom cylinder 2 is driven stretchably to ascend or raise the boom. In this case, when an overload occurs in the boom cylinder 2, an overload exceeding a predetermined pressure is applied to the port relief valve 7 installed in the first path 2*a*, so that the hydraulic fluid flowing in the first path 2*a* passes through the port relief valve 7 and then is drained to the hydraulic tank. At this time, the hydraulic fluid relieved after passing through the port relief valve 7 immediately passes through the orifice valve 9 and then is drained to the hydraulic tank. In other words, when the boom cylinder 2 is driven stretchably to cause an overload to occur, the hydraulic fluid passing through the port relief valve 7 can be promptly drained to the hydraulic tank.

While the present invention has been described in connection with the specific embodiments illustrated in the drawings, they are merely illustrative, and the invention is not limited to these embodiments. It is to be understood that various equivalent modifications and variations of the embodiments can be made by a person having an ordinary skill in the art without departing from the spirit and scope of the present invention. Therefore, the true technical scope of the present invention should not be defined by the abovementioned embodiments but should be defined by the appended claims and equivalents thereof.

INDUSTRIAL APPLICABILITY

As described above, according to the hydraulic circuit for controlling a boom of a construction machine in accordance with an embodiment of the present invention, when an overload is applied to the boom cylinder in a state in which the boom is not manipulated, a large chamber-side hydraulic fluid of the boom cylinder passes through the orifice and then is relieved so that the descending movement of the boom can be mitigated, and thus an operator can prevent abrupt safety accidents.

The invention claimed is:

1. A hydraulic circuit for controlling a boom of a construction machine, comprising:

a hydraulic pump connected to an engine;

a boom cylinder connected to the hydraulic pump through a first path and a second path;

a boom control valve shiftably installed in a flow path provided between the hydraulic pump 1 and the boom cylinder and configured to be shifted to control a start, a stop, and a direction change of the boom cylinder;

a holding valve including a holding poppet installed between the boom control valve and the first flow path of the boom cylinder and a drain valve configured to supply or discharge a hydraulic fluid to or from a back pressure chamber of the holding poppet so that the natural descending movement of the boom is prevented when the boom control valve is in a neutral state;

a port relief valve installed in the first path at the downstream side of the holding poppet and configured to relieve the hydraulic fluid when an overload occurs in the first path; and an orifice valve installed at the downstream side of the port relief valve and configured such that when the boom control valve is in a neutral state, the hydraulic fluid passing through the port relief valve passes through an orifice to relieve the hydraulic fluid, and when the boom control valve is shifted by a boom-up pilot signal pressure that is applied thereto and a part of the boom-up pilot signal pressure is applied to a signal pressure-receiving portion of the orifice valve, the hydraulic fluid passing through the port relief valve is discharged to a hydraulic tank.

2. The hydraulic circuit for controlling a boom of a construction machine according to claim 1, wherein the orifice valve is shifted by the boom-up pilot signal pressure that is generated by the lever manipulation of a remote control valve for manipulating a work apparatus.

3. A hydraulic circuit for controlling a boom of a construction machine, the hydraulic circuit comprising:

a hydraulic pump connected to an engine;

a boom cylinder connected to the hydraulic pump through a first path and a second path;

a boom control valve arranged in a flow path provided between the hydraulic pump and the boom cylinder, the boom control valve configured to be shifted to control a start, a stop, and a direction change of the boom cylinder;

a holding valve including:

a holding poppet arranged between the boom control valve and the first flow path of the boom cylinder; and a drain valve configured to supply or discharge a hydraulic fluid to or from a back pressure chamber of the holding poppet so that the natural descending movement of the boom is prevented when the boom control valve is in a neutral state;

a port relief valve arranged in the first path at the downstream side of the holding poppet and configured to relieve the hydraulic fluid when an overload occurs in the first path;

an orifice valve including an orifice and arranged on a downstream side of the port relief valve, the orifice valve movable between a first position and a second position, in the first position hydraulic fluid relieved after passing through the relief port valve passes through the orifice prior to being discharged to a hydraulic tank, in the second position hydraulic fluid relieved after passing through the relief port valve does not pass through the orifice prior to being discharged to the hydraulic tank;

a remote control valve, actuation of the remote control valve to raise the boom supplies a boom-up pilot signal pressure to the boom control valve to shift the boom control valve, and supplies the boom-up pilot signal pressure to the orifice valve to move the orifice valve to the second position;

wherein:

when an overload is applied to the boom cylinder in a descending direction when the boom is not being manipulated and is thus in a neutral state, the orifice valve is arranged in the first position such that hydraulic fluid relieved after passing through the port relief valve passes through the orifice of the orifice valve and is subsequently discharged to the hydraulic tank so as to reduce a discharge rate of the hydraulic fluid and reduce a descending rate at which the boom descends in response to the overload; and when an overload is applied to the boom cylinder in the descending direction when the boom is being raised, the orifice valve is arranged in the second position such that hydraulic fluid relieved after passing through the port relief valve passes through the orifice valve to the discharge tank without passing through the orifice and without the discharge rate being reduced.

* * * * *